United States Patent [19]

Ruland

[11] Patent Number: 4,827,813

[45] Date of Patent: May 9, 1989

[54] TORQUE WRENCH WITH AMPLIFYING GAUGE

[75] Inventor: Fred F. Ruland, Weston, Mass.

[73] Assignee: Ruland Manufacturing Company, Inc., Watertown, Mass.

[21] Appl. No.: 204,607

[22] Filed: Jun. 9, 1988

[51] Int. Cl.[4] ..... B25B 23/142

[52] U.S. Cl. ..... 81/477; 81/478

[58] Field of Search ..... 81/467, 472, 477–479, 81/483; 73/862.21, 862.23, 862.26

[56] References Cited

U.S. PATENT DOCUMENTS

| | | | |
|---|---|---|---|
| 2,934,946 | 5/1960 | Engquist | 73/862.23 X |
| 3,283,620 | 11/1966 | Bailey . | |
| 3,308,690 | 3/1967 | LaPointe | 81/478 |
| 3,611,796 | 10/1971 | Hayward | 81/477 X |
| 4,314,490 | 2/1982 | Stone | 81/479 |
| 4,664,001 | 5/1987 | Denman . | |

FOREIGN PATENT DOCUMENTS

| | | | |
|---|---|---|---|
| 467451 | 8/1950 | Canada | 81/478 |
| 968194 | 5/1975 | Canada . | |
| 621277 | 1/1927 | France | 81/483 |

*Primary Examiner*—James G. Smith

*Attorney, Agent, or Firm*—Lahive & Cockfield

[57] ABSTRACT

A torque wrench for tightening a threaded fastener, comprising a torque transmitting driver and having a fastener engaging tip and a gauge responsive to bending of the rod for providing an amplified indication of the amount of applied torque.

21 Claims, 2 Drawing Sheets

TORQUE WRENCH WITH AMPLIFYING GAUGE

RELATED PATENT APPLICATION

This Application is related to co-pending patent application Ser. No. 204,709 entitled "Torque Wrench", and patent application Ser. No. 204,712 entitled "Torque Wrench" both filed on even date herewith, the specification of both being incorporated herein.

BACKGROUND AND OBJECTS OF THE INVENTION

This invention relates to hand tools, and more particularly to torque wrenches.

A torque wrench is a hand tool which allows the user to tighten a threaded fastener to a predetermined torque. Using a torque wrench helps prevent over-tightening which can lead to stripping of threads, break-off of fasteners or other difficulties. It also helps prevent under-tightening which can result in the fastener failing to perform, such as by working itself loose over time.

Generally an inexpensive variety of torque wrench in prevalent use is the "beam" type shown in FIG. 1 and designated 10. At one end, a male socket head 12 is provided for use with interchangeable sockets (not shown). A handle 14 is located at the other end, with a straight beam 16 interposed between the socket head 12 and the handle 14. The beam 16 is a metal rod, for example, having a cylindrical geometry with a length of approximately 15 to 24 inches (38 to 61 cm). A dial 18 is affixed to the beam 16 at a point adjacent to the handle 14. A needle, or pointer 20 is secured at or near the socket head 12, extending towards the handle 14, parallel to the beam 16, and culminating at its free end with a marker or point 22 wituated within a slot or elongate window 24 in the dial 18. The slot 24 extends generally in a direction perpendicular to the beam 16.

In use, the beam-type torque wrench 10 is secured to a threaded fastener (not shown), such as a hexagonal headed bolt or screw or a nut, by means of interchangeable sockets attached to the socket head 12. An operator turns the wrench 10 via handle 14 in either of the directions indicated by the arrows "a" or "b", and thereby tightens or loosens the fastener. During tightening, the torque wrench 10 fulfills its primary purpose by providing a read-out or display of the torque applied to the fastener. Initially during tightening of the fastener, substantially all manually applied torque results in a turning of the socket head 12. At some point, however, the turning of the wrench 10 by handle 14 results in not only the turning of the socket head 12, but also a significant bending or bowing of the beam 16. For example, this can occur when the fastener starts to seat. During this condition, the end of the beam 16 adjacent the handle is displaced in the direction of arrow "a" relative to the remainder of the beam 16. Since needle 20 floats at its distal end, being not attached at that end to the beam 16, the needle's marker 22 moves relative to the dial's scale. When the user sees that the needle has swung to a pre-selected torque read-out, the fastener has been tightend to the proper amount.

Other types of torque wrenches are also known. For example, dial-type and adjustable torque wrenches are intended for more professional mechanics. These torque wrenches are generally more expensive than beam-type wrenches, although the former are typically more accurate and sensitive, and sometimes more delicate than beam-type wrenches.

An object of the invention is to provide a relatively inexpensive torque wrench; one which can be used and discarded by purchasers of products requiring assembly using a torque wrench.

A further object of the invention is to provide a torque wrench of simple yet rugged design which can be readily manufactured and then packaged without the need for specialized packing materials to protect the torque wrench during transit.

SUMMARY OF THE INVENTION

The above and other objects of the invention are accomplished by a torque wrench used for tightening a threaded fastener, comprising a torque transmitting driver rod having an "L" shape and a fastener engaging tip, such as an Allen wrench, and a read-out or gauge assembly responsive to bending of the rod for providing an amplified indication of the amount of applied torque.

The gauge assembly includes an elongated reference member which is connected to the portion of the driver rod bearing the fastener engaging tip, and preferably near that fastener engaging tip. The reference member supports a cross member bearing indicia representative of an analog torque scale. The reference member includes a pivotal connection near its end opposite the point of connection with the driving rod. An elongated pointer member, having a pointer tip at a first free end, is pivotally coupled to the reference member at the first pivotal connection. The pointer member is pivotally coupled to the distal end of the rod at a second pivotal connection near the end of that pointer member opposite the pointer tip so that the pointer tip is directed towards though not necessarily to the scale, and generally towards the fastener engaging tip. Preferably the first and second pivotal connections are made by means of pins disposed parallel to one another. The first connection can further include a clamp which holds the rod and is secured to the pointer member by the pin. Alternatively, the first connection can include a socket integrally formed with the rod and extending orthogonally therefrom towards the pointer member, and a ball-headed pin partially received and axially captured within the socket. Of course these components can be reversed, if desired, so that the pin contains a socket-head and a protrusion from the rod ends in a ball configuration. The second connection is disposed between the first connection and the pointer tip.

When the torque wrench is unloaded, i.e., when no torque is being applied to a fastener, the pointer tip indicates this by, for example, pointing to a zero or other base reference or datum, and the reference member and the pointer member are disposed at an acute angle of, for example, 0°–30° with respect to one another. As torque is applied to a fastener by means of the rod, the rod bends about an axis parallel to the central axis of the engaging tip. The movement of the rod at the second pivotal connection causes the pointer member to be angularly displaced with respect to the reference member so that the pointer tip shifts angular due to bending of the rod and, in cooperation with the scale, provides a continuous indication of applied torque. This indication is amplified, compared to that of some prior art beam type torque wrenches which provide direct read-out. The amplification factor depends on the dimensions of the elements of the read-out asssembly, and is for the preferred embodiment equal to the distance $D_2$ between the second connection and the scale (at the location indicated by the pointer tip) divided by the distance $D_1$ between the first and second connections. Preferably these dimensions and therefore, this ratio, remain constant during use. Therefore, the scale should preferably define an arc having a center of curvature coincident with the second connection or, at least, the markings on the scale fall on radii extending from the second connection.

DETAILED DESCRIPTION OF DRAWINGS

The foregoing and other objects of this invention, the various features thereof, as well as the invention itself, may be more fully understood from the following description when read with reference to the accompanying drawings, in which.

DESCRIPTION OF THE PREFERRED EMBODIMENT

Figure 1:
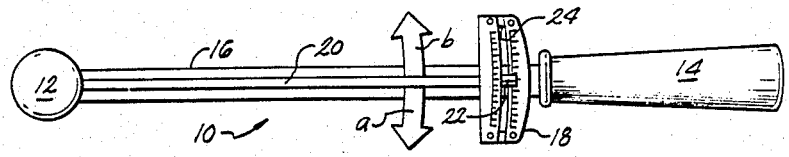
FIG. 1 (PRIOR ART)
FIG. 1 is a top plan view of a prior art torque wrench.

A torque wrench 30 in accordance with the invention is shown in FIGS. 2–5 as comprising, and preferably essentially consisting of, a torque transmitting driver 32, and a read-out or gauge assembly 34 for indicating a torque.

The driver 32 comprises, and preferably consists essentially, of an "L"-shaped rod 35 having a first, substantially straight leg portion 36 connected orthogonally and endwise to a second substantially straight leg portion 38. The free, or distal, end of the second leg portion 38 includes a fastener engaging tip 40. In the preferred embodiment, the rod 35 is of heat treated, steel bar stock, although other materials may be used. As shown, the entire rod 36 is characterized by a hexagonal cross-sectional configuration. Alternatively, the fastener engaging tip 40 can have the desired cross-section, and the balance of the rod 34 can be, for example, of a round cross-section.

The fastener engaging tip 40 is configured to be received within and rotationally engage a hex socket 42 of a fastener 44 such as, for example, a socket head cap screw.

The read-out or gauge assembly 34 shall now be described. The gauge assembly 34 includes an analog force scale 50 and the pointer assembly cooperating with the scale 50 so as to indicate the amount of torque being generated at the tip 40 in response to an applied force at the distal end of the first leg 34. The pointer assembly preferably includes an elongated pointer member 52 defining a pointer axis **52*a*, and including a double tapered tip 54 at its anterior or free end which serves as a pointer or, if desired, a marker. The pointer member 52** preferably is substantially straight.

A substantially-straight elongated reference member 62 is connected to the rod 35 near its fastener engaging tip 40, and preferably along the second leg portion 38, defining a reference axis **62*a*. In the preferred embodiment, the connection to the second leg portion 38 is effected by providing a hole 64 through the reference member 62 near a first end 66 thereof having a diameter selected so as to permit the hole 64 to receive the second leg portion 38 with a tight friction fit so as to prevent, or limit, slippage in the circumferential direction. In one form of the invention, the hole 64 may have a hexagonal shape, matching the cross-section of the leg portion 38. The end of the reference member 62 opposite to the point of connection to leg 38 of rod 32 is connected to the posterior end of the pointer member 52 at a location between its connection to the rod 35 and the tip 54 of the pointer member 52**.

The scale 50 comprises a series of lines and/or alphanumeric or other symbols inscribed or marked on a dial 58 comprising a cross member 56 affixed to reference member 62. The cross member 56 is elongated in a direction transverse, i.e., at an angle, to the principal axis of the extension link 62. The principal axis **52*a* of the pointer member 52 is directed generally towards the scale 50**.

The pointer member 52 is connected at its posterior end to the first leg portion 36 of the rod 35 at a location which is near its end 58 which is distal from the second leg portion 38, or at a location at least nearer to the distal end 58 then to the end connected to the second leg portion 38. For reasons which will be apparent from the below discussion of the use of the torque wrench, the connection between the pointer member 52 and the rod 35 should preferably be as close to the distal end 58 as is feasible.

The nature and relative locations of the connections between the pointer member 52 and leg 36 of the rod 35 and between the reference member 62 and the pointer member 52 are important in achieving the amplification of the force indication. Both of the connections are pivotal connectons which permit pivotal motion about axes which are substantially parallel to one another and to the central axis of the second leg portion 38. The connecton between the leg 36 and pointer member 52 also permits the leg 36 to slide with respect to the pivot axis as indicated by the arrows **70*a* and 70*b*** in FIG. 2.

The connection between the pointer member 52 and the rod 35 is effected in the preferred embodiment, for example, by a lose-fitting collar 70 extending around the first leg portion 36 and a pin 72 having a head portion disposed in the interior of the collar 70 and a shank portion extending radially therethrough. The collar 70 and pin 72 are shown more clearly in enlargement in FIG. 3 with the pointer member 52 shown in phantom. The loose-fitting clamp permits sliding movement of the leg 36 through the clamp, so that the coupling so-established permits slidable and pivotable movement of the leg 36 with respect to the point of coupling on the pointer member 52. In alternate configurations, as described below in conjunction with FIG. 4, differing forms of junctions to leg 36 may be used.

In assembly of the preferred embodiment, the shank portion of the pin 72 is extended through a hole in the posterior end of the pointer member 52, intermediate its width, and then the tip of the shank is swaged or otherwise flattened as shown in phantom at reference number 74 so as to capture the pointer member 52 between the collar 70 and the flattened tip, preferably with little or no freedom of axial movement along the pin's shank but with considerable, preferably interference free, freedom of pivotal movement about the pin's shank.

The connection between the first pointer member 52 and reference member 62 is effected by a pin 76 received likewise with a clearance fit through holes in the pointer and reference members 52, 62 in a manner similar to that described in the preceding paragraph with reference to pin 72. Here, however, the pointer and reference members 52, 62 are sandwiched together between the pin's head and its flattened shank's tip.

Figure 2:
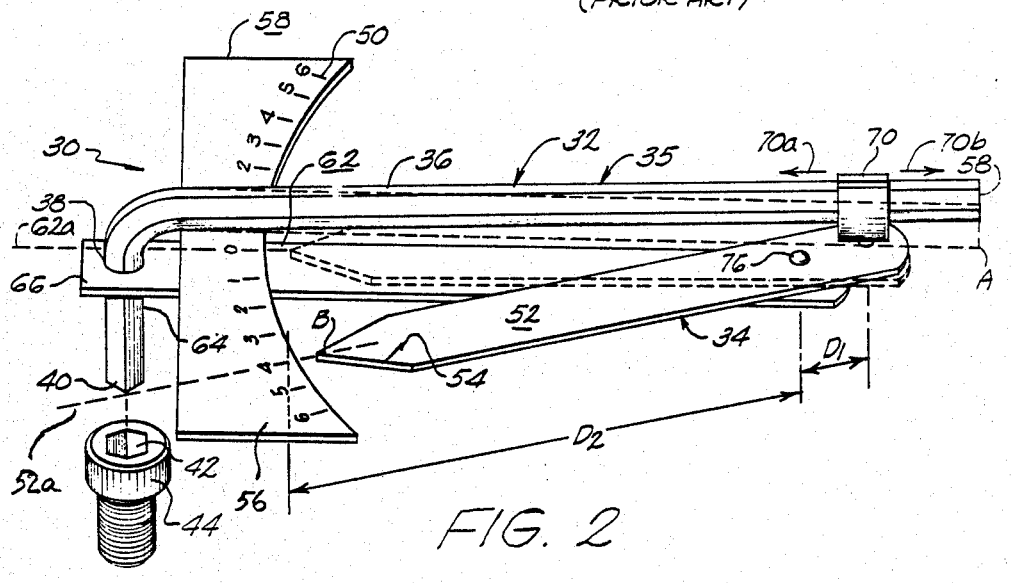
FIG. 2 is a perspective view of a torque wrench according to the invention in combination with a fastener.
Figure 3:
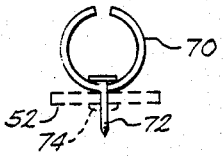
FIG. 3 is a sectional view of the pointer member-rod attachment features of FIG. 2.

While scale 50 could be affixed to reference member 62 for use in conjunction with the pointer 54, as shown in FIG. 2, in other embodiments, a scale may be affixed to the pointer member 52 for use in conjunction with a pointer affixed to the reference member.

Also, in the illustrated embodiments, the so-called "first" pivotal connection (between pointer and reference members 52, 62) and the so-called "second" pivotal connection (between pointer member 52 and leg 36) are relatively positioned so that a positive amplification factor is established with the pointer 54 as used in conjunction with the scale 50, as located between that first pivotal connection and leg 38. However, in alternate embodiments, the relative positions of the first and second pivotal connections may be reversed so that a positive amplification factor is established between a pointer at the other end of the pointer member and a scale positioned beyond the first pivotal connection.

In use of the torque wrench 30, the first leg portion 36 is manually gripped by one hand along it portion distal from the second leg portion 38. The fastener engaging tip 40 is inserted into the hex socket of the fastener to be tightened. Before the application of force, the pointer tip 54 of the first member 52 is directed to a location along the scale 50 which serves as a reference datum or zero point (as shown in phantom in FIGS. 2 and 4). In other words, an arc connecting the marked locations of the scale is intersected by the pointer axis **52*a* of the first member 52 at the reference datum or zero point along the reference axis 62*a***.

Figure 4:
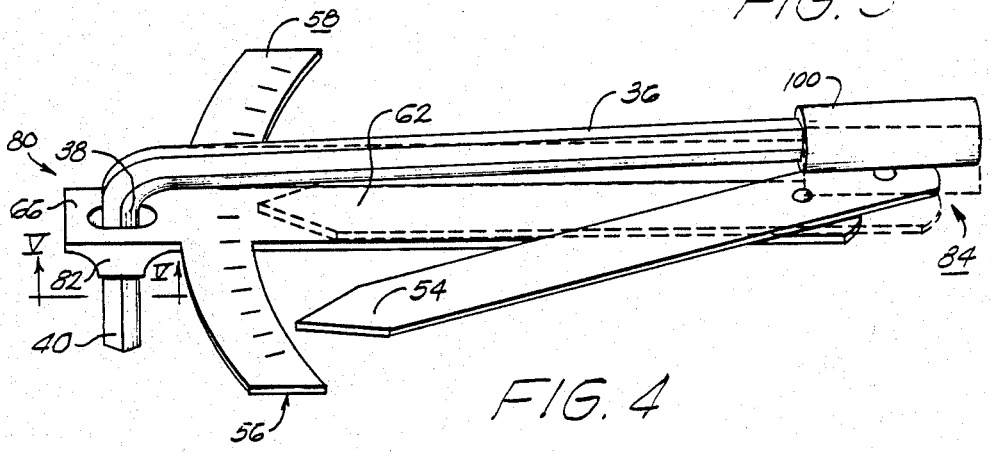
FIG. 4 is a perspective view of an alternative embodiment of the invention.
Figure 5:
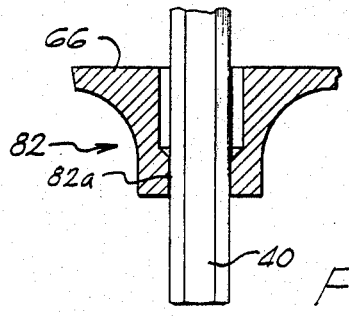
FIG. 5 is a sectional view taken along line V—V of FIG. 4.

As torque is applied to the leg portion 36 of driver 32, that torque is transmitted from the first leg portion 36 to the second leg portion 38 and then to the screw head. The wrench and screw are thus turned together about the central axis of the second leg portion 38. As the material into which the screw 44 is being turned begins to resist further turning, the applied torque results not only in rotation of the wrench 30, but also twisting of the second leg portion 38 and bending of the leg portion 36 so as to displace the leg eventually to the position shown in phantom and designated "A" in FIG. 2. As such, the pointer member 52 is caused to pivot, moving it to its position designated "B" (as shown in FIGS. 2 and 4). Consequently, the pointer tip 54 shifts angularly from pointing to the reference datum to some other location along the scale, which with appropriate calibration of the scale is indicative of the amount of displacement of the pointer member 52 and therefore of the amount or level of force applied to the driver 32. The calibration of the scale must of course take into account the dimensions and material properties of the wrench if it is to be determined mathematically. Preferably, however it is arrived at empirically.

It will be appreciated by one skilled in the art that the force indication just described is amplified to facilitate reading of the scale. The amplification is achieved by the interposition of the reference member 62 in the arrangement and permits the operation of its pin connection to the pointer member 52 to serve as a fulcrum as well as a pivot. The application of simple engineering mechanics yields the amplification factor as being equal to the ratio of the distance $D_2$ between the fulcrum and the scale location, with respect to the distance $D_1$ between the fulcrum and the connection between the pointer member 52 and the rod 35. That is:

$$\text{Amplification Factor} = D_2/D_1$$

Preferably the torque wrench 30 is sized and configured so as to maximize $D_2$ and minimize $D_1$ so as to take advantage of the full range of scale 50.

FIG. 4 shows an alternative embodiment of a torque wrench 80 in accordance with the invention. Since it is structurally and functionally similar to the torque wrench 30, the above discussion applies by analogy, and needs only to be augmented with a short description of the differences between the torque wrenches in order to convey an understanding of this embodiment. For convenience, the same reference numbers shall be used where applicable.

In torque wrench 80 of FIG. 4, the cross and reference members 58, 62 are integrally fashioned in one piece, preferably molded of plastic. At the first end 66 of the reference member 62, an axial projection 82 extending downwardly towards the fastener engaging tip 40 improves the effectiveness of the attachment of the second member 62 to the second leg portion 38 by providing a gauge-to-wrench coupling region **82*a* (shown in FIG. 5) in proximity to the fastener engaging tip 40. This enables the gauge assembly 34 to more effectively respond to both bending of the first leg portion 36 and twisting of the second leg portion 38 when force is applied to the first leg portion 36. Alternatively, the gauge-to-wrench coupling region 82*a* may be adapted to affix the gauge to the wrench at a point away from tip 40 so that displacement of the pointer tip is a measure of the bending of the first leg portion 36 only. The cross member 56 is again preferably fashioned from an elongate sheet of rigid plastic or other material, but this time includes two arcuate edges concentrically disposed and intersected at their mid-points by the reference member 62**.

Figure 6:
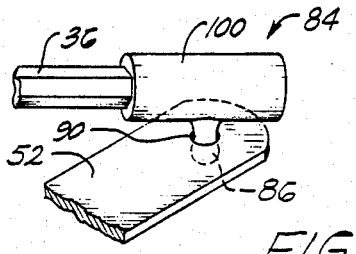
FIG. 6 is an exploded perspective view of the pointer member-rod attachment features of FIG. 4.

The connection between the pointer member 52 and the rod 35 in this embodiment is achieved by coupling assembly 84 including a ball and socket joint shown in greater detail in FIG. 6.

The ball and socket joint of assembly 84 includes a ball-shaped, spherical or frusto-spherical head 86 with spherical surfaces at least along its lateral face extending from the outer surface of a slip-on sleeve member 100 which is slidably positioned over the distal end of leg portion 36. The head 86 is captively received within a circular hole (i.e. "socket") 90 in the distal end of pointer member 52. Thereby captive fit prevents accidental removal of the pin 88 from the socket 90. However, if disassembly is desired, the ball head 88 can be "snapped" axially out of the socket 90. Other slide-permitting fastener assemblies can also be used to achieve the connection. Such alternatives include a "pin-in-slot" assembly having a pin fixedly extending from leg portion 36 into a slot in the first member 52, for example.

The invention can be embodied in other specific forms without departing from the spirit or essential characteristics thereof. For example, while in the above described embodiments the fastener engaging tip 40 has a hexagonal cross section, the invention can be practiced by substituting other configurations suitable to engage fasteners requiring slotted, philips, hex-head, star, security or other drivers. Such configurations can be made by cold forming or plastic molding. All of these alternatives are well within the skill of an engineer practicing in this art.

The described embodiments of the invention are to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. A torque wrench comprising:

a torque transmitting rod including a first leg, and a second leg connected end-wise to said first leg and extending substantially perpendicularly therefrom, and said rod having a fastener engaging tip at the distal end of said first leg;

a read-out assembly including means responsive to bending of said rod for indicating the torque transferred by said rod, said indicating means including:

A. a reference member and associated means for affixing said reference member to said first leg, B. a pointer member and first connection means for pivotally connecting a first connection point on said pointer member to said reference member, and C. second connection means for slidingly and pivotally connecting a second connection point on said pointer member to said second leg of said rod, whereby the angular position of said pointer member with respect to said reference member provides said indication of said transferred torque.

2. The torque wrench of claim 1 wherein said affixing means includes a holder member including means for slip-on attachment to said first leg.

3. The torque member of claim 2 wherein said attachment means is adapted for attachment to said rod near said distal end of said first leg.

4. The torque wrench of claim 1 wherein said indicating means includes an analog scale and a pointer cooperating with said scale so as to indicate said transferred torque.

5. The torque wrench of claim 4 wherein said scale is affixed to said reference member and said pointer is affixed to said pointer member.

6. The torque wrench of claim 4 wherein said pointer is affixed to said reference member and said scale is affixed to said pointer member.

7. The torque wrench of claim 1 wherein said first connection point is closer to said first leg than is said connection point.

8. The torque wrench according to claim 1 wherein said connection point is closer to said first leg than is said first connection point.

9. The torque wrench of claim 4 wherein said first and second connection points on said pointer member are spaced from one another by a distance $D_1$ and said first connection point and said scale are spaced by a distance $D_2$, and whereby said torque indication is characterized by a scale factor of $D_2$ divided by $D_1$.

10. The torque wrench of claim 1 wherein said fastener engaging end includes a hexagonal cross-sectional configuration.

11. A torque wrench comprising a torque transmitting rod having a fastener engaging tip at a first end and a handle portion at a second end, an elongated pointer member having first and second ends, first means for pivotally connecting said torque transmitting rod to said pointer member proximate said second end of said torque transmitting rod and said second end of said pointer member, an elongated reference member connected at a first end to said torque transmitting rod proximate said fastener engaging tip thereof, second means for pivotally connecting said pointer member to said reference member proximate a second end of said reference member and said second end of said pointer member such that said pointer member is pivotal with respect to said torque transmitting rod about a first axis and with respect to said reference member about a second axis, said second axis disposed between said first end of said pointer member and said first axis, wherein the distance from the connection between said torque transmitting rod and said reference member to said second axis is less than the distance from said connection between said torque transmitting rod and said reference member to said first axis.

12. The torque wrench of claim 11 wherein said torque transmitting rod comprises an Allen wrench.

13. A torque read-out gauge assembly for connection to one leg of an L-shaped wrench having a first leg and a second leg extending substantially perpendicular to said first leg, comprising:

a read-out assembly including means responsive to bending of said rod for indicating the torque transferred by said rod, said indicating means including:

A. a reference member and associated means for affixing said reference member to said first leg, B. a pointer member and first connection means for pivotally connecting a first connection point on said pointer member to said reference member, and C. second connection means for slidingly and pivotally connecting a second connection point on said pointer member to said second leg of said rod, wherein the angular position of said pointer member with respect to said reference member provides said indication of said transferred torque.

14. The gauge of claim 13 wherein said affixing means includes a holder member including means for slip-on attachment to said first leg.

15. The gauge of claim 14 wherein said attachment means is adapted for attachment to said rod near said distal end of said first leg.

16. The gauge of claim 13 wherein said indicating means includes an anaog scale and a pointer cooperating with said scale so as to indicate said transferred torque.

17. The gauge of claim 16 wherein said scale is affixed to said reference member and said pointer is affixed to said pointer member.

18. The gauge wrench of claim 16 wherein said pointer is affixed to said reference member and said scale is affixed to said pointer member.

19. The gauge of claim 13 wherein said first connection point is closer to said first leg than is said second connection point.

20. The gauge according to claim 13 wherein said second connection point is closer to said first leg than is said first connection point.

21. The gauge of claim 16 wherein said first and second connection points on said pointer member are spaced from one another by a distance $D_1$ and said first connection point and said scale are spaced by a distance $D_2$, and whereby said torque indication is characterized by a scale factor of $D_2$ divided by $D_1$.

* * * * *